US005181725A

United States Patent [19]

Leras et al.

[11] Patent Number: 5,181,725

[45] Date of Patent: Jan. 26, 1993

[54] SOCCER SHOOTING TRAINING TARGET

[76] Inventors: Nicholas J. Leras, 163 Laurelwood La., Ormond Beach, Fla. 32174; John P. Condorodis, 800 Marvin Rd., Ormond Beach, Fla. 32176

[21] Appl. No.: 801,883

[22] Filed: Dec. 3, 1991

[51] Int. Cl.[5] ..... A63B 63/00

[52] U.S. Cl. ..... 273/402; 273/411

[58] Field of Search ..... 273/398, 400, 401, 402, 273/411

[56] References Cited

U.S. PATENT DOCUMENTS

| | | | |
|---|---|---|---|
| 3,215,432 | 11/1965 | Lee et al. | 273/401 X |
| 3,938,806 | 2/1976 | Husbands | 273/411 |
| 4,286,786 | 9/1981 | Papadopoulas | 273/411 X |
| 4,826,166 | 2/1989 | Baker et al. | 273/402 X |
| 4,921,257 | 5/1990 | Heller | 273/401 |
| 4,948,147 | 8/1990 | Pallanca | 273/402 |

FOREIGN PATENT DOCUMENTS

| | | | |
|---|---|---|---|
| 3524715 | 1/1987 | Fed. Rep. of Germany | 273/401 |

*Primary Examiner*—William H. Grieb
*Attorney, Agent, or Firm*—Paul S. Rooy

[57] ABSTRACT

A soccer shooting training target which may be easily rolled up and transported can be installed over an existing soccer goal. The target comprises a plurality of individual targets containing flaps sized to admit passage to a soccer ball. The soccer shooting training target's upper edge is tied in place to the goal rear crossbar using a weighted rope. The bottom corners of the soccer shooting training target are tied down using elastic cord and stakes in order to render the target stable in the presence of wind. Alternate soccer shooting training target configurations include a stand mounted free standing version and a canister housed target permanently mounted to a soccer goal crossbar.

12 Claims, 7 Drawing Sheets

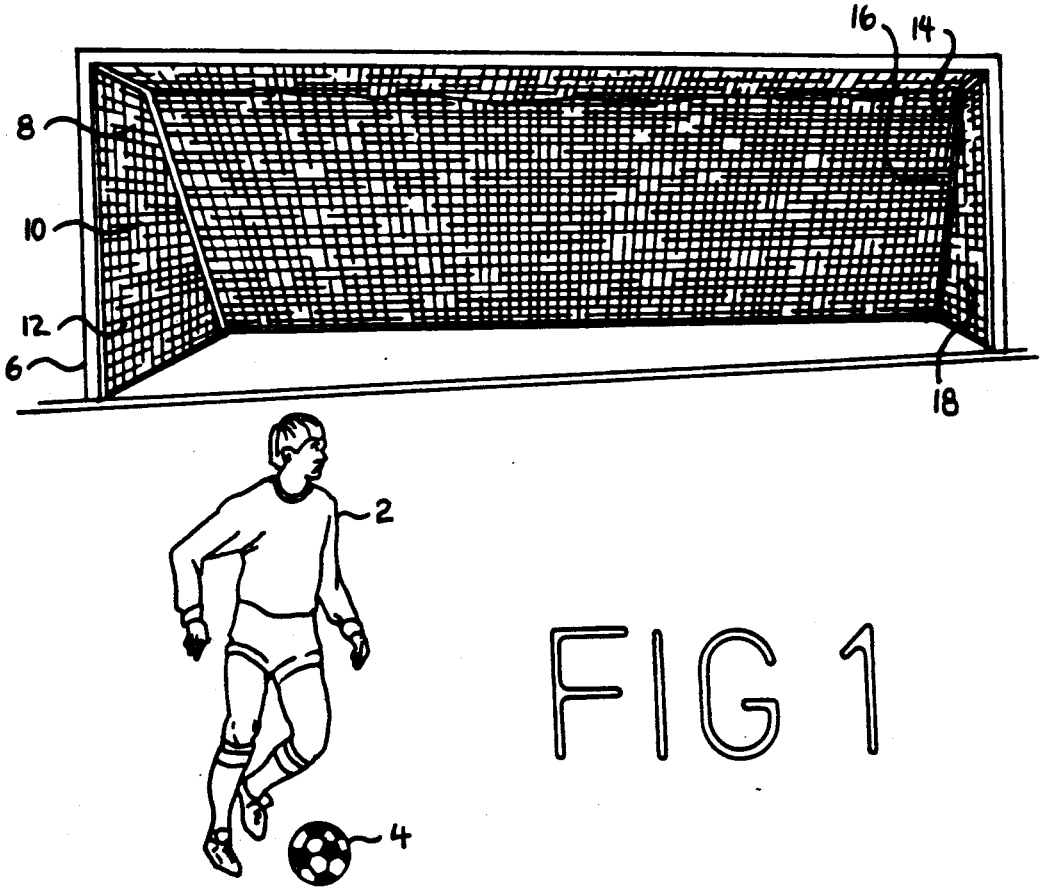
FIG 1
FIG 2
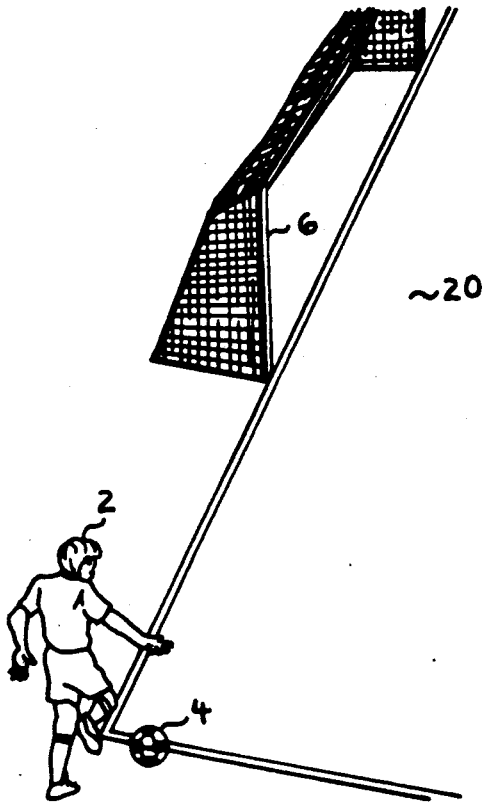

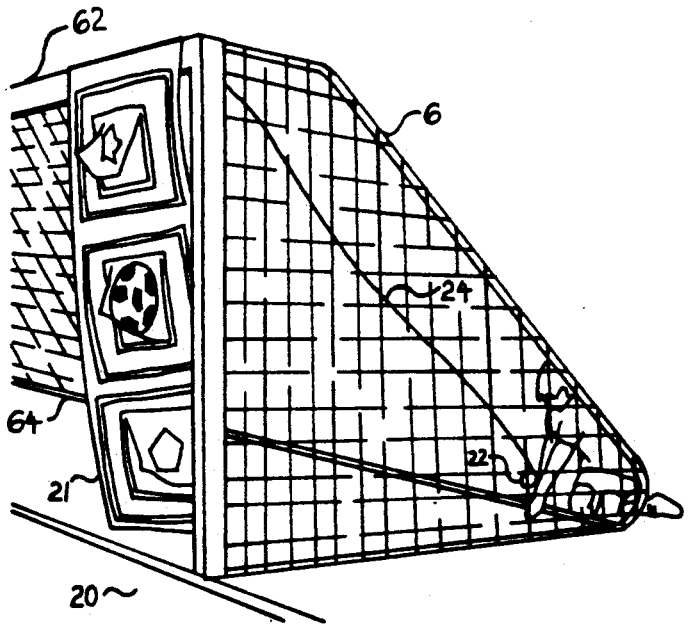
FIG 6
FIG 7
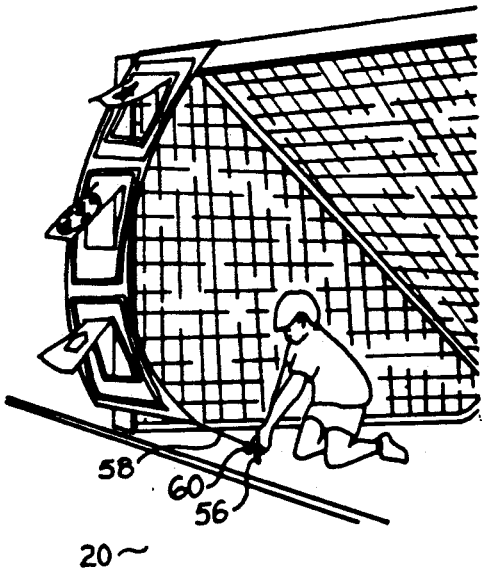

FIG 8
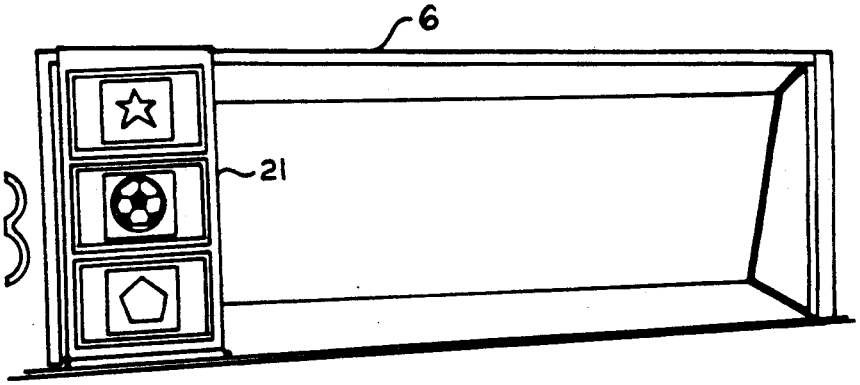
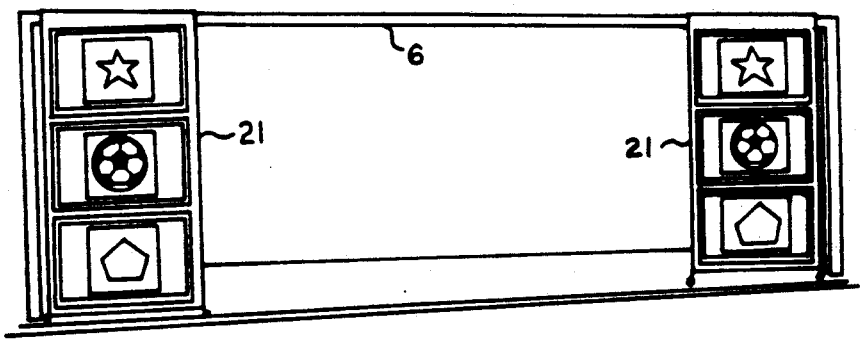
FIG 9
FIG 10
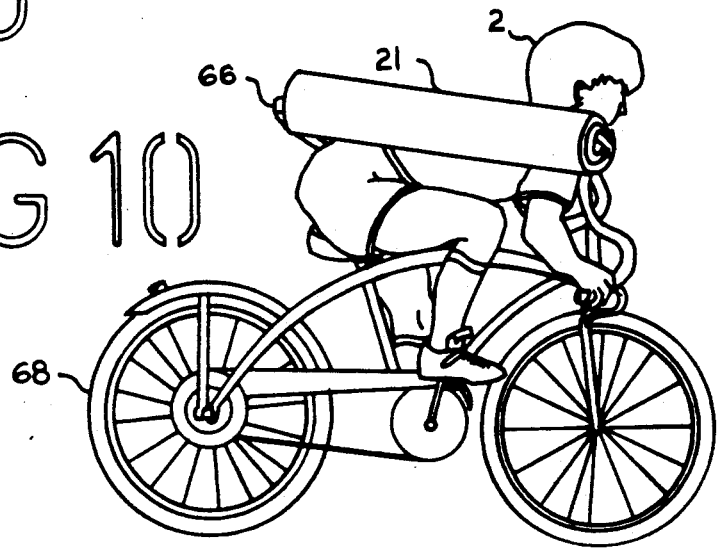

FIG 15
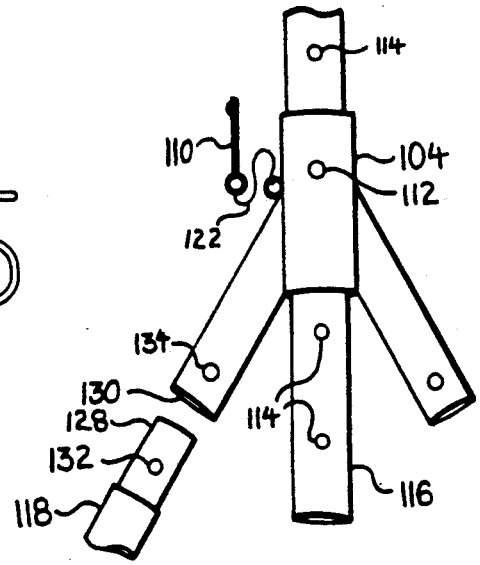
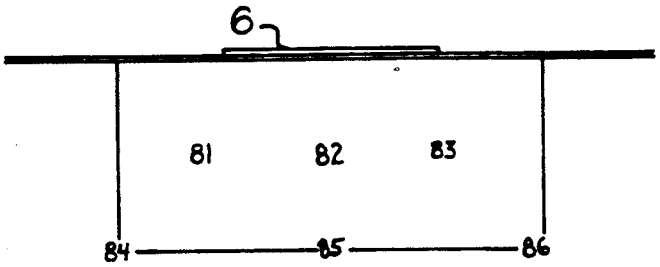
FIG 16
FIG 17
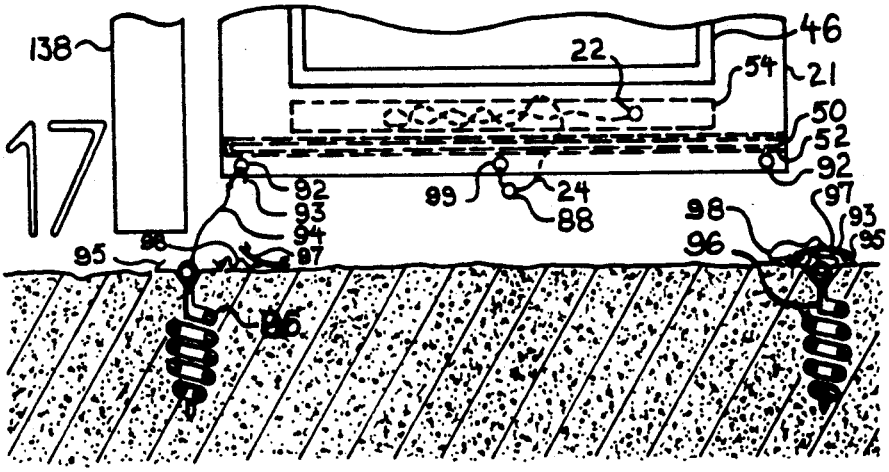

SOCCER SHOOTING TRAINING TARGET

BACKGROUND OF THE INVENTION

1. Field of the Invention

The present invention relates to sports training devices and in particular to a soccer target to be used in shooting training.

2. Background of the Invention

Soccer, one of the world's most popular games, is played by two opposing teams on a large rectangular playing field having a goal centered on each of it's short sides. Goals worth one point each are scored by propelling the soccer ball through the opposing team's goal. The winning team is that team having the greatest number of points at the conclusion of play.

The importance of being able to propel the ball through the opposition's goal accurately is clear: the greater the percentage of successful shots on the competition's goal, the greater the chance of winning the game. Most goals are scored where the means of propelling the ball through the goal is kicking ("shooting") the ball.

Soccer goals generally comprise a framework made of two vertical uprights connected at their top by a horizontal member (called a crossbar) to define a rectangular goal opening whose longer sides are parallel to the playing surface. Structural bracing may be provided behind the uprights, and a net may be connected around the uprights, crossbar and upright bracing to define a goal space. Each goal is defended by a goalkeeper who may use any part of his body to stop the ball.

The goalkeeper is most frequently disposed in the center of the goal. This situation gives rise to the existence of sweet spots located at the four corner areas of the goal. If a player can shoot the ball through one of the sweet spots his chances of scoring are significantly increased due to the location of the sweet spots remote from the goalkeeper.

Soccer is a low scoring game. Many opportunities to score are missed. The ball usually sails high over the goal's crossbar or on a trajectory passing sufficiently close to the goalkeeper to allow him to stop the ball, thereby preventing a goal.

This aiming problem exists because shots on goal are not practiced enough and the player attempting the shot is often distracted by the goalkeeper.

One reason soccer players do not practice goal shooting enough is a training apparatus doesn't exist that makes goal shooting fun, and whose use would allow the practice of entertaining exercises as well as competitive games that are enjoyable and are designed to enhance shooting skills.

It is difficult for a player to avoid shooting the ball at the goalkeeper because soccer presents an unnatural situation. In other sports the athlete has something at which to aim: a catcher's mitt, a basketball hoop, or a swinging tire for the football quarterback. In soccer the player must shoot away from something: the goalkeeper. It is hard for a soccer player to visualize a nontarget.

A corner kick occurs when the ball goes out of bounds at the defensive end after being touched by a defensive player. The offense is then allowed to kick the ball from the corner. An adept corner kicker who can place the ball where he wants can be a lethal weapon in this situation. An effective target training device does not exist to hone the corner kicker's ball placement skills.

2. Prior Art

Heller (U.S. Pat. No. 4,921,257) discloses a Soccer Training Device which is a goal incorporating a cruciform center screen leaving uncovered the four sweet spot corner areas of the goal. This Training Device suffers form a number of drawbacks: as the device is designed as a stand alone training item, it is large and difficult to transport, and the cruciform screen is not easily installed on an existing goal.

The Training device appears relatively difficult to assemble and costly, and only presents four target areas. In addition, the four corner target areas appear to be nontargets in that the cruciform center screen presents a more vivid visual impact than the target areas themselves.

Baker in U.S. Pat. No. 4,826,166 teaches a Football Target Assembly that includes a throw-through target and net backstop. While the target provides a visual image at which to aim the ball, this device appears costly, difficult to transport and provides only one target at which to shoot. In addition, the target support assembly with counterweight seems unstable in the presence of wind.

Papadopoulos discloses a Soccer Training Goal in U.S. Pat. No. 4,286,786. The device appears relatively difficult to transport and cannot be mounted on an existing goal. While one of Papadopoulos' embodiments provides for markings on a backplate, no specific sweet spot targets are provided.

SUMMARY OF THE INVENTION

Accordingly, it is an object of this invention to provide a soccer shooting training target which provides clear sweet spot targets with vivid visual impact.

It is another object of this invention to provide a soccer shooting training target which makes the practice of shooting at the goal more fun and more challenging, and which creates the desire to practice longer.

It is still another object of this invention to provide a soccer shooting training target which makes a mental imprint that is useful under the pressures of game conditions.

It is another object of this invention to provide a soccer shooting training target which is easily and quickly installed on an existing soccer goal.

It is still another object of this invention to provide a soccer shooting training target which is easily transported.

It is yet another object of this invention to provide a soccer shooting training target which can be positioned to be used in the practice of corner kicks.

It is still another object of this invention to provide a soccer shooting training target which is easily installed and stable in the presence of wind.

BRIEF DESCRIPTION OF THE DRAWINGS

The invention, together with the other objects, features, aspects and advantages thereof will be more clearly understood from the following in conjunction with the accompanying drawings.

Seven sheets of drawings are provided. Sheet one contains FIGS. 1 and 2, sheet two contains FIG. 3, sheet three contains FIGS. 4 and 5, sheet four contains FIGS. 6 and 7, sheet five contains FIGS. 8, 9 and 10, sheet six contains FIGS. 11, 12, 13 and 14, and sheet seven contains FIGS. 15, 16 and 17.

FIG. 1 is a front isometric view of a soccer goal.

FIG. 2 is an elevated isometric view of a soccer goal showing a corner kick scenario.

FIG. 6 is a side isometric view of the fifth step required to install a soccer shooting training target.

FIG. 7 is a side isometric view of the sixth step required to install a soccer shooting training target.

FIG. 8 is a front isometric view of a soccer goal with one soccer shooting training target installed.

FIG. 9 is a front isometric view of a soccer goal with two soccer shooting training targets installed.

FIG. 10 is a side isometric view of a soccer shooting training target rolled up and being transported by bicycle.

FIG. 15 is a front isometric view of a soccer shooting training target stand through joint.

FIG. 16 is a top view of a soccer playing field in the proximity of a goal.

FIG. 17 is a side view of a permanent anchor installation.

DETAILED DESCRIPTION OF THE PREFERRED EMBODIMENT

Referring now to FIG. 1 we can observe a soccer player 2 playing a soccer ball 4 in front of soccer goal 6. Goal sweet spots are located at 8, 10, 12, 14, 16 and 18, but are not marked on goal 6 in any way.

FIG. 2 depicts the player 2 preparing to execute a corner kick using soccer ball 4. There are no marks on playing field 20 to indicate the correct place to kick the ball for a given play.

Figure 3:
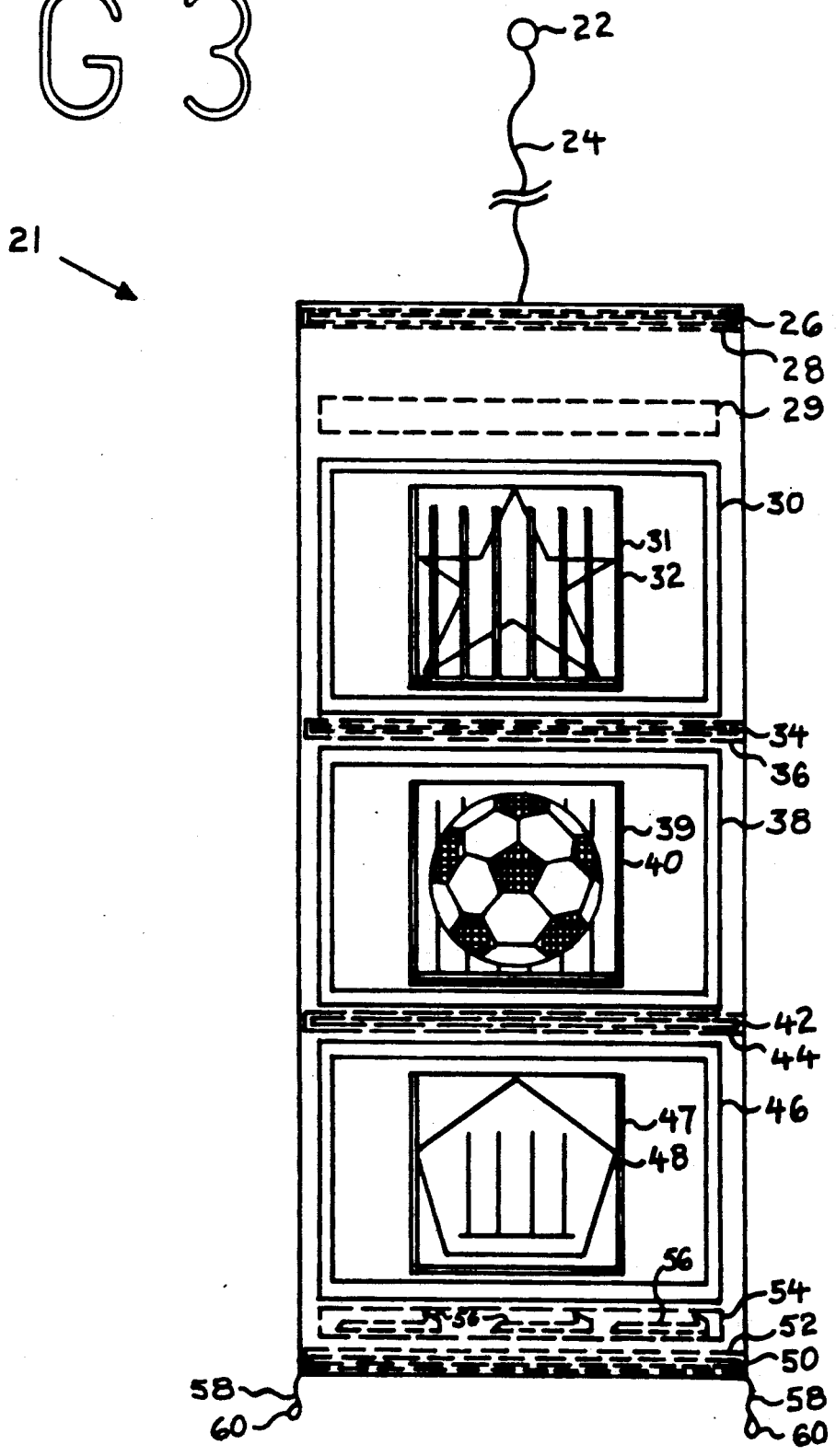
FIG. 3 is a front view of the soccer shooting training target.

FIG. 3 is a front view of a soccer shooting training target 21. We can observe weight 22 attached to top rope 24. Top rope 24 is attached to the upper edge of soccer shooting training target 21. When not in use, weight 22 and top rope 24 may be stored in upper storage pocket 29. Upper storage pocket 29 is located on the rear side of soccer shooting training target 21. Soccer shooting training target 21 may be largely constructed of nylon fabric or mesh or similar material.

Horizontal rigidity is enhanced through rigid members 26 and 50 which are installed in sleeves 28 and 52 respectively and through batons 34 and 42 which are installed in sleeves 36 and 44 respectively. Rigid members 26 and 50 may be made of polymer or similar material pipe, while batons 34 and 42 may be made of fiberglass or similar material.

We can see upper target 30, center target 38 and lower target 46. These targets 30, 38 and 46 are large enough to provide relatively easy shooting targets. Disposed within targets 30, 38 and 46 are upper aperture 31, center aperture 39 and lower aperture 47 respectively, sized sufficiently largely so as to admit passage to a soccer ball. Upper target flap 32, center target flap 40 and lower target flap 48 hang in apertures 31, 39 and 47 respectively in order to provide vivid visual images at which to shoot. The markings on targets 30, 38 and 46 and flaps 32, 40 and 48 may be colored brilliantly so as to maximize the targets' visual impact.

At the rear bottom part of soccer shooting training target 21 we can discern lower storage pocket 54 which houses stakes 56. Elastic cord loops 60 are connected to the lower corners of soccer shooting training target 21 by means of elastic cords 58. Two stakes 56 may be inserted through elastic cord loops 60 and driven into the playing field 20 in order to render soccer shooting training target 21 stable in the presence of wind.

Installation

Figure 4:
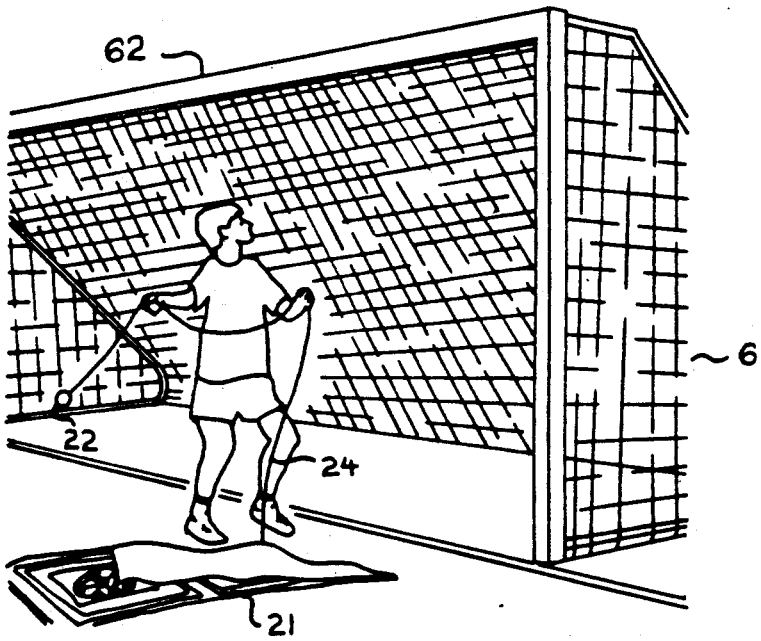
FIG. 4 is a side isometric view of the first three steps required to install a soccer shooting training target.

1. Referring to FIG. 4, the soccer shooting training target 21 may be placed on the crossbar 62 at any location along the length of goal 6. Place the soccer shooting training target 21 in front of the goal 6 at the desired location. It is not necessary to unroll soccer shooting training target 21.

2. Remove weight 22 and top rope 24 from upper storage pocket 29. Make sure top rope 24 is not tangled.

3. Throw weight 22 over crossbar 62 as far as possible.

Figure 5:
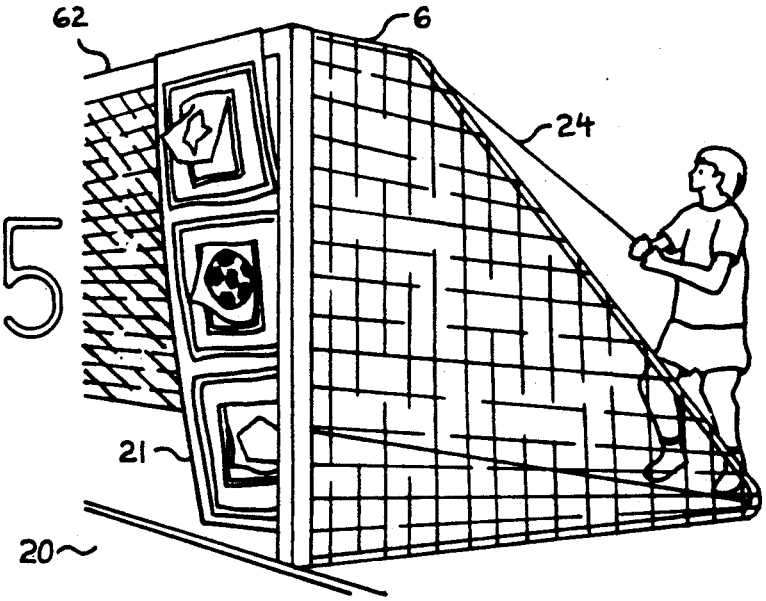
FIG. 5 is a side isometric view of the fourth step required to install a soccer shooting training target.

4. Referring to FIG. 5, go around to the rear of goal 6 and grasp weight 22 and top rope 24. Pull top rope 24 towards the rear of the goal 6. As top rope 24 is pulled, soccer shooting training target 21 will start to rise into position. Pull until the upper rigid member 26 settles behind crossbar 62. At this time the bottom of soccer shooting training target 21 will be just above the playing field 20.

5. Referring to FIG. 6, most soccer goals 6 have a rear crossbar 64. Loop weight 22 and top rope 24 under rear crossbar 64. Confirm soccer shooting training target 21 is in the correct position, with upper rigid member 26 just behind crossbar 62 and the bottom of soccer shooting training target 21 just above playing field 20. Tie top rope 24 to rear crossbar 64.

If the goal 6 in question does not have a rear crossbar 64, drive a stake 56 into the ground behind goal 6 and attach top rope 24 to stake 56 so that soccer shooting training target 21 is suspended in the correct position.

6. Referring to FIG. 7, if it is a windy day, remove two stakes 56 from lower storage pocket 54. Insert the stakes 56 through elastic cord loops 60 and drive stakes 56 into the playing field 20 so as to hold the soccer shooting training target in a vertical position.

FIG. 8 depicts a soccer shooting training target 21 installed at the left extreme of goal 6.

FIG. 9 shows one soccer shooting training target 21 installed at the left extreme of goal 6 and another installed at the extreme right of goal 6.

FIG. 10 illustrates a soccer shooting training target 21 in the rolled up position for transportation. Soccer player 2 is transporting soccer shooting training target 21 on bicycle 68 using strap 66.

Permanently Installed Target

Figure 11:
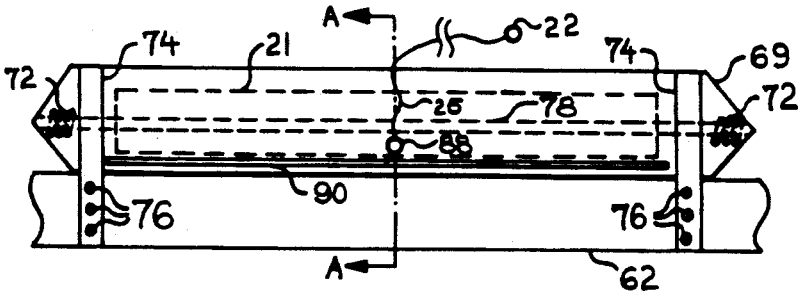
FIG. 11 is a top view of a soccer shooting training target permanent mounting installation.

Referring to FIG. 11, an alternate configuration for the soccer shooting training target 21 is a permanent installation mounted behind crossbar 62. Soccer shooting training target 21 is wrapped around spindle 78 and spring loaded in the retracted position by springs 72. One end of each spring 72 is connected to canister 69 and the other end to spindle 78. The top of soccer shooting training target 21 is attached to spindle 78. Stop ball 88 prevents bottom rope 25 from retracting into cylindrical canister 69 through slot 90 and maintains the correct tension in springs 72 to keep soccer shooting training target 21 in the retracted position. The canister 69 may be made of metal, plastic or similar material.

Soccer shooting training target 21 is housed within canister 69; canister 69 is mounted to crossbar 62 by means of arcuate straps 74 and screws 76. Weight 22 is attached to the end of bottom rope 25 that is not connected to soccer shooting training target 21.

Figure 12:
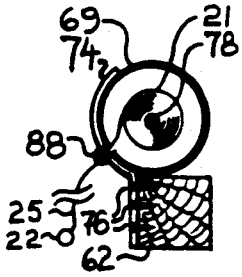
FIG. 12 is a cross sectional view of a soccer shooting training target permanent mounting installation at section A—A of FIG. 11.

FIG. 12 is a cross section of FIG. 11 at A—A. We can observe soccer shooting training target 21 wrapped around spindle 78, as well as bottom rope 25 extending through slot 90. Stop ball 88 maintains spindle 78 in the correct spring loaded condition, and weight 22 is attached to the free end of bottom rope 25. Canister 69 is mounted to crossbar 62 by means of straps 74 and screws 76.

Soccer shooting training target 21 is extended into position by pulling down on bottom rope 25 and weight 22 in order to extend soccer shooting training target 21 into position through slot 90 and over the front of crossbar 62.

Referring to FIG. 17, soccer shooting training target 21 is now secured into the extended position by inserting hooks 93 through eyelets 92. Hooks 93 are attached to bungie cords 94. Bungie cords 94 are connected to permanent anchors 96. Weight 22 and bottom rope 25 may be stored in lower storage pocket 54 while soccer shooting training target 21 is in the extended position. Bungie cords 94 and with attached hooks 93 are stored in conical anchor storage cups 95 when not in use. Goal upright 138 is visible next to soccer shooting training target 21.

When bungie cords 94 and hooks 93 are stored in anchor storage cups 95, anchor storage cup tops 97 are installed on top of anchor storage cups 95 to prevent soccer players from stepping into anchor storage cups 95, and for aesthetic reasons. Anchor storage cups 95 and anchor storage cup tops 97 may be manufactured of hard rubber or similar material.

When an anchor storage cup top 97 is removed from its anchor storage cup 95 it remains attached to anchor storage cup 95 by means of anchor storage cup top lanyard 98 to prevent loss.

FIG. 17 also shows lower target 46, sleeve 52 containing lower rigid member 50, rope 24 connected to center eyelet 99 and stop ball 88.

Free Standing Target

Figure 13:
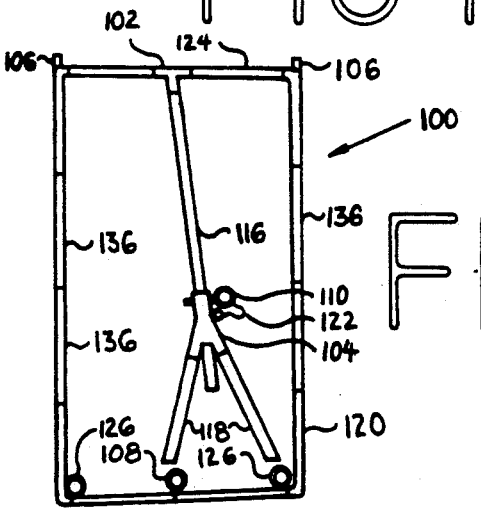
FIG. 13 is a front isometric view of a soccer shooting training target stand.

Referring to FIG. 13 we can see a target stand 100 upon which soccer shooting training target 21 may be mounted. The target stand 100 is comprised of rectangular frame 120 connected to through member 116 by means of T joint 102, and legs 118 connected to through member 116 by means of through joint 104. The target stand 100 is assembled using tube sections 136 constructed of aluminum or plastic or similar material.

When a soccer shooting training target 21 is installed on target stand 100, side retainers 106 prevent the soccer shooting training target 21 from sliding off target stand 100 sideways. The soccer shooting training target 21 is installed on target stand 100 same as on a conventional soccer goal 6, treating upper frame member 124 same as goal crossbar 62. Top rope 24 is tied to rope tie ring 108, and elastic cords 58 are tied to elastic cord tie rings 126.

T joint 102 allows through member 116 to rotate relative to frame 120.

Referring to FIG. 15 we can observe that through member 116 is free to slide inside through joint 104, thus changing the angle between the soccer shooting training target 21 installed on frame 120 and playing field 20. Through joint 104 is slid to the desired position on through member 116 and the diametrically opposed through joint hole pair 112 is aligned with the corresponding diametrically opposed through member hole pair 114. Quick release pin 110 is then inserted through the through joint 104 and through member 116, locking into place the angle between soccer shooting training target 21 and playing field 20. Quick release pin 110 is connected to through joint 104 by means of quick release pin lanyard 122.

Target stand 100 is designed to be easily disassembled into its component tube sections 136 (FIG. 13). FIG. 15 shows a typical junction between tube sections 136. In this case we are looking at the connection of leg 118 to through joint 104. Leg male tube end 128 is inserted into through joint female tube end 130. Leg 118 is then rotated relative to through joint 104 until spring loaded button 132 seats in buttonhole 134.

Operation

The soccer shooting training target may be used in numerous excercises and games designed to hone the soccer player's shooting skills in an interesting and fun manner. The following are a few examples.

First Exercise: Arrange the target on the far left corner of the goal 6 as depicted in FIG. 8. Stand a comfortable distance from the goal 6. Kick at the soccer shooting training target 21 using the inside of the right foot. Work at being able to kick to the lower target 46, center target 38 or upper target 30 at will. Gradually increase the distance as it becomes easier to hit the targets. Go no farther back than the penalty spot 85 in FIG. 16.

Second Exercise: Move the target to the right side of the goal 6. Using the inside of the left foot kick at the target. Work your way back same as before.

Figure 14:
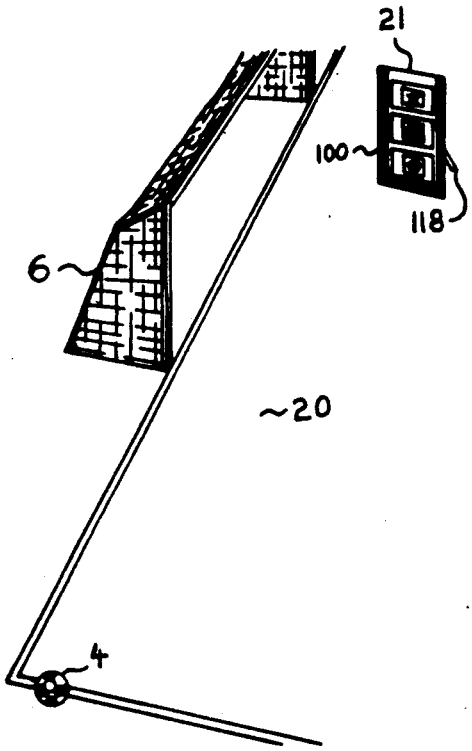
FIG. 14 is an elevated isometric view of a freestanding soccer shooting training target located in front of a soccer goal, ready for corner kick practice.

Third Exercise: Install a soccer shooting training target 21 on a target stand 100 and position on playing field 20 in front of goal 6 as illustrated in FIG. 14. Practice corner kicking the soccer ball 4 through the targets.

First Game—H.E.A.D.E.R.: Play is similar to the basketball game "H.O.R.S.E.". The starting player selects a shooting position from 81 to 86 (FIG. 16) and a specific target location at which to aim. Should the player correctly make the chosen shot the next player in line would be required to repeat the same shot. Each player in line must continue to make the shot if the player in front of him/her is successful. Should a player miss a shot he/she receives a letter from the word "H.E.A.D.E.R." and the next player in line has the opportunity to select the next shot that must be attempted. If a player receives all the letters from the word he/she is out of the game and the remaining players continue until there is only one player left. The last remaining player wins.

While a preferred embodiment of the invention has been illustrated herein, it is to be understood that changes and variations may be made by those skilled in the art without departing from the spirit and scope of the appending claims.

We claim:

1. A rectangular soccer shooting training target comprising a plurality of vertically disposed targets marked upon the front of said soccer shooting training target, each of said targets containing an aperture large enough to admit passage to a soccer ball, each of said targets containing a flap bearing markings, one edge of said flap being connected to the upper edge of one said aperture, said rectangular soccer shooting training target further comprising:

a horizontal sleeve at the top of said soccer shooting training target, an upper rigid member disposed within said horizontal sleeve at the top of said soccer shooting training target, a horizontal sleeve at the bottom of said soccer shooting training target, a lower rigid member disposed within said horizontal sleeve at the bottom of said soccer shooting training target, a plurality of batons disposed within horizontal sleeves along the height of said soccer shooting training target, said upper rigid member, said lower rigid member and said batons contributing to the horizontal rigidity of said soccer shooting training target, and means to attach said soccer shooting training target to a soccer goal.

2. The soccer shooting training target of claim 1, further comprising:

an upper storage pocket disposed on the upper rear of said soccer shooting training target, a lower storage pocket disposed on the lower rear of said soccer shooting training target, 3. The soccer shooting training target of claim 2 wherein the means to attach said soccer shooting training target to a soccer goal comprises:

a top rope attached to the top center of said soccer shooting training target, said top rope being stored in said upper storage pocket when not in use, and a weight attached to the free end of said top rope.

4. The soccer shooting training target of claim 2 and:

a plurality of stakes contained within said lower storage pocket, and an elastic cord terminating in a loop attached to each of the lower corners of said soccer shooting training target whereby one of said stakes may be inserted into one of said loops and driven into the ground, thereby rendering said soccer shooting training target stable in the presence of wind.

5. The soccer shooting training target of claim 2 in combination with a permanent mounting installation, said permanent mounting installation comprising:

a cylindrical canister, said canister having a longitudinal slot, an axially disposed cylindrical spindle contained within said canister, said soccer shooting training target being wrapped around said spindle, the top of said soccer shooting training target being attached to said spindle, a spring located at each end of said spindle, one end of each said spring being attached to said spindle and the other end of each said spring being attached to said canister, said springs being radially pre-loaded so as to urge the spindle into a radial orientation which tends to urge said soccer shooting training target into the retracted position, a bottom rope attached to the bottom center of said soccer shooting training target, said bottom rope emerging from said canister through said slot, a stop ball whose diameter is larger than the width of said slot attached to said bottom rope, said stop ball serving to prevent said bottom rope from retracting into said canister and said stop ball further serving to halt the rotation of said spindle in a spring loaded position, a weight attached to the free end of said bottom rope, and means to mount said canister to a soccer goal crossbar.

6. The soccer shooting training target and permanent mounting installation combination of claim 6 wherein said means to mount said canister to a goal crossbar comprises:

a plurality of arcuate straps attached to said canister, each of said straps terminating in a flat strip containing a plurality of holes, and screws which can be inserted through the strap holes and screwed into the goal crossbar.

7. The soccer shooting training target and permanent mounting installation combination of claim 5 and:

anchors installed into the ground underneath each lower corner of said soccer shooting training target, a conical anchor storage cup installed around the top of each said anchor, each said anchor cup having an anchor storage cup top attached to the anchor storage cup by means of an anchor storage cup top lanyard, a bungie cord attached to each of said anchors, a hook attached to the free end of each of said bungie cords, and an eyelet located at each lower corner of said soccer shooting training target wherethrough said hooks may be engaged, thereby holding said soccer shooting training target in the extended position.

8. The soccer shooting training target of claim 2 in combination with a target stand, said target stand comprising:

a rectangular frame, a through member rotatably connected to the top center of said rectangular frame by means of a T joint, legs attached to a through joint, said through member being capable of sliding axially inside said through joint, diametrically opposed pairs of through member holes disposed along the length of said through member, a diametrically opposed pair of holes in said through joint, and a quick release pin capable of being inserted simultaneously through the through joint holes and a pair of said through member holes, thereby fixing the angle between the plane of said frame and the surface upon which said target stand rests, said quick release pin being attached to said through joint by means of a quick release pin lanyard.

9. The soccer shooting training target and target stand combination of claim 8 and:

side retainers mounted on the top corners of said frame, elastic cord tie rings located in the bottom corners of said frame, and a rope tie ring disposed at the bottom center of said frame.

10. The soccer shooting training target and target stand combination of claim 9 wherein said target stand is comprised of tube sections capable of being quickly disassembled and assembled, each junction between adjacent tube sections comprising:

a female tube end having a buttonhole, and a male tube end sized so as to be insertable into said female tube end, and a spring loaded button disposed on said male tube end, said spring loaded button being sized so as to seat in said buttonhole, thereby locking the male tube end and the female tube end together.

11. A rectangular soccer shooting training target comprising a plurality of vertically disposed targets marked upon the front of said soccer shooting training target, each of said targets containing an aperture large enough to admit passage to a soccer ball, each of said targets containing a flap bearing markings, one edge of said flap being connected to the upper edge of one said aperture, a plurality of horizontal sleeves along the height of said soccer shooting training target, a plurality of batons disposed within said horizontal sleeves along the height of said soccer shooting training target, said batons contributing to the horizontal rigidity of said soccer shooting training target.

12. The soccer shooting training target of claim 11 further comprising:

an upper rigid member disposed within one said horizontal sleeve at the top of said soccer shooting training target, said batons and said upper rigid member contributing to the horizontal rigidity of said soccer shooting training target.

* * * * *

UNITED STATES PATENT AND TRADEMARK OFFICE

CERTIFICATE OF CORRECTION

PATENT NO. : 5,181,725

DATED : Jan. 26, 1993

INVENTOR(S) : Leras et al.

It is certified that error appears in the above-identified patent and that said Letters Patent is hereby corrected as shown below:

Column 2 Line 3: "2." should read "3."

Column 6 Line 41: should start a new paragraph.

Column 8 Line 15: "claim 6" shoul read "claim 5"

Signed and Sealed this

Eleventh Day of January, 1994

*Attest:*

*Attesting Officer*

BRUCE LEHMAN

*Commissioner of Patents and Trademarks*